US011549496B2

(12) United States Patent
Elmer, Jr. et al.

(10) Patent No.: US 11,549,496 B2
(45) Date of Patent: Jan. 10, 2023

(54) RECONFIGURABLE MULTI-STAGE GAS COMPRESSOR

(71) Applicant: Estis Compression, Kilgore, TX (US)

(72) Inventors: William Elmer, Jr., Tyler, TX (US); Will Nelle, San Angelo, TX (US)

(73) Assignee: ESTIS COMPRESSION, LLC, Kilgore, TX (US)

( * ) Notice: Subject to any disclaimer, the term of this patent is extended or adjusted under 35 U.S.C. 154(b) by 69 days.

(21) Appl. No.: 17/097,369

(22) Filed: Nov. 13, 2020

(65) Prior Publication Data

US 2021/0148344 A1 May 20, 2021

Related U.S. Application Data

(60) Provisional application No. 62/936,066, filed on Nov. 15, 2019.

(51) Int. Cl.

| | |
|---|---|
| ***F04B 47/00*** | (2006.01) |
| ***F04B 1/143*** | (2020.01) |
| ***F04B 53/08*** | (2006.01) |

(52) U.S. Cl.

CPC ..... *F04B 1/143* (2013.01); *F04B 53/08* (2013.01); *F04B 47/00* (2013.01)

(58) Field of Classification Search

CPC ..... F04B 5/02; F04B 7/0266; F04B 53/162; F04B 53/16; F04B 53/10; F04B 53/007;

(Continued)

(56) References Cited

U.S. PATENT DOCUMENTS 2,198,098 A * 4/1940 Vaughan ..... C10G 5/06 62/619
5,211,021 A * 5/1993 Pierson ..... F17C 5/02 141/82

(Continued)

FOREIGN PATENT DOCUMENTS

CN 106930927 A 7/2017
DE 916203 C 8/1954

(Continued)

*Primary Examiner* — Thomas Fink
(74) *Attorney, Agent, or Firm* — FisherBroyles, LLP; Jason P. Mueller

(57) ABSTRACT

Disclosed embodiments include a reconfigurable multi-stage gas compressor having a first-stage compression cylinder, a second-stage compression cylinder, and two stepped cylinders. Each of the stepped cylinders include first and second compression cylinders. The gas flow paths through the stepped cylinders are configured in a user-selectable configuration to be in series or in parallel so that the reconfigurable multi-stage gas compressor functions as one of: a three-stage compressor, as a four-stage compressor, and as a hybrid three/four stage compressor. In first and second configurations, the system generates four stages of compression and outputs 4-stage compressed gas through a single exit port, and through dual exit ports, respectively. In a third configuration, the system outputs hot and cooled 3-stage compressed gas through first and second ports and 4-stage compressed gas through a third port. In a fourth configuration, the system outputs hot and cooled 3-stage compressed gas with no 4-stage compressed gas.

6 Claims, 9 Drawing Sheets

(58) Field of Classification Search
CPC ..... F04B 53/1047; F04B 53/1045; F04B 53/104; F04B 53/1037; F04B 39/12; F04B 39/123; F04B 39/125; F04B 9/10–117; F04B 47/04; F04B 47/00–145; F04B 15/02; F04B 19/003
See application file for complete search history.

(56) References Cited

U.S. PATENT DOCUMENTS

| | | | | |
|---|---|---|---|---|
| 5,482,443 | A | 1/1996 | Bez | |
| 8,231,357 | B2 | 7/2012 | Huttar | |
| 2003/0215339 | A1 | 11/2003 | Grimmer | |
| 2008/0170948 | A1* | 7/2008 | Martinez | F25J 1/0022 417/244 |
| 2013/0164151 | A1* | 6/2013 | Huttar | F04C 18/16 417/206 |
| 2019/0331414 | A1* | 10/2019 | Krishnamurthy | F25J 1/0223 |
| 2020/0340582 | A1* | 10/2020 | Ootsuka | F04B 53/16 |

FOREIGN PATENT DOCUMENTS

| | | | |
|---|---|---|---|
| DE | 102016111100 | A1 * | 12/2017 |
| DE | 102016111100 | A1 | 12/2017 |
| EP | 3486485 | A1 | 5/2019 |

* cited by examiner

RECONFIGURABLE MULTI-STAGE GAS COMPRESSOR

This application claims priority to U.S. Patent Application No. 62/936,066, filed Nov. 15, 2019, the entire contents of which are incorporated herein by reference.

BRIEF DESCRIPTION OF THE DRAWINGS

The accompanying drawings form a part of this disclosure and are incorporated into the specification. The drawings illustrate example embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION

Figure 1:
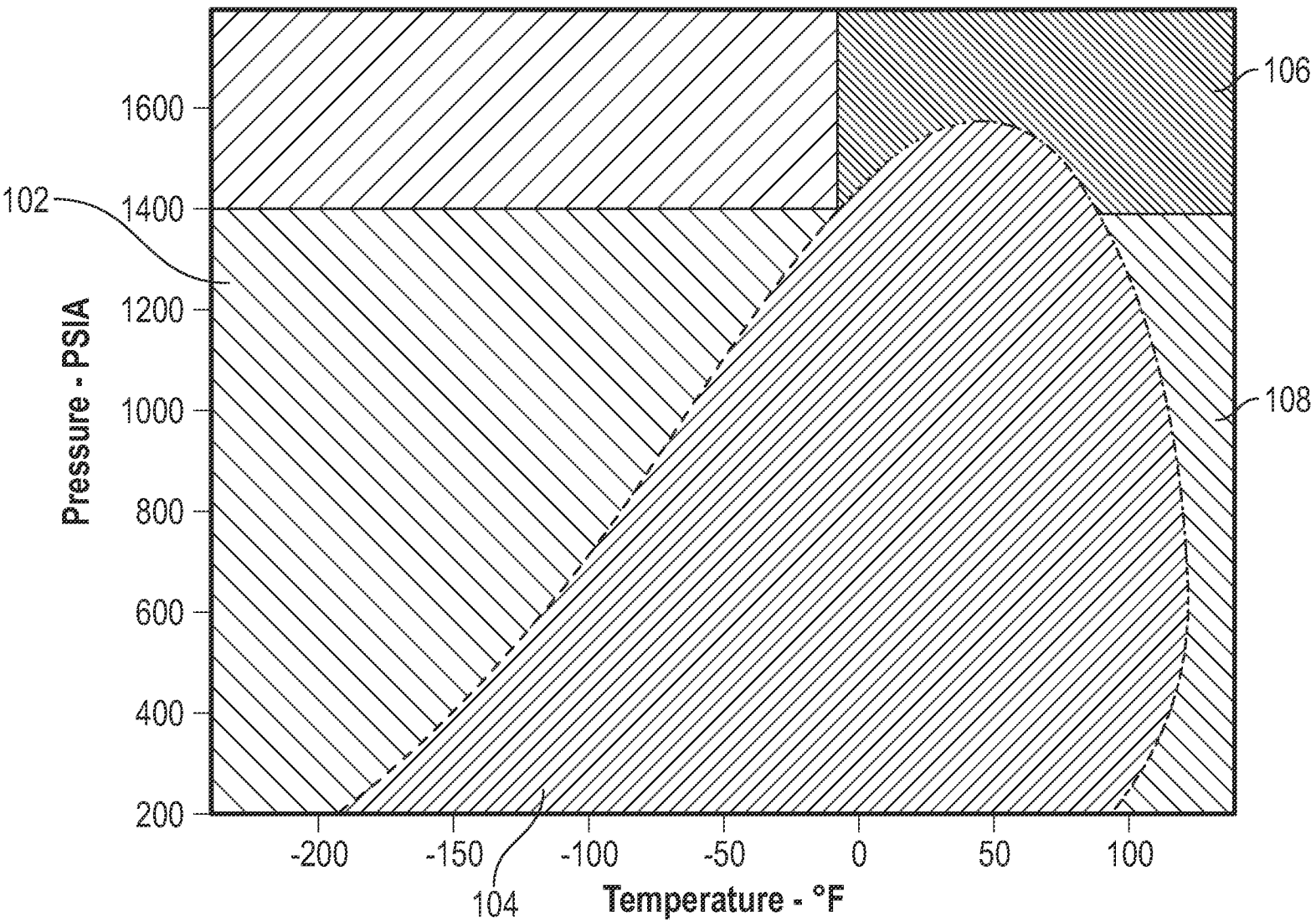
FIG. 1 shows the pressure-temperature phase diagram of natural gas relevant to the compressor technology of this disclosure, according to some embodiments.

This disclosure generally relates to a gas compressor system that is configurable to generate high-pressure gas required for High Pressure Gas Lift (HPGL) and is reconfigurable to generate lower pressure gas appropriate for conventional gas lift operations. Thus, a single gas compressor system according to an embodiment of the present disclosure may be used throughout the life of a well because it is reconfigurable to meet various pressure requirements as well pressure and production volume decreases over time.

Wellbores drilled for the production of oil and gas often produce fluids in both the gas and liquid phases. Produced liquid phase fluids may include hydrocarbon oils, natural gas condensate, and water. When a well is first completed, the initial formation pressure is typically sufficient to force liquids up the wellbore and to the surface along with the produced gas. However, during the life of a well, the natural formation pressure tends to decrease as fluids are removed from the formation. As this downhole pressure decreases over time, the velocity of gases moving upward through the wellbore also decreases, thereby resulting in a steep production decline of liquid phase fluids from the well. Additionally, the hydrostatic head of fluids in the wellbore may significantly impede the flow of gas phase fluids into the wellbore from the formation, further reducing production. The result is that a well may lose its ability to naturally produce fluids in commercially viable quantities over the course of the life of the well.

Various artificial lift methods have been developed to increase production from such a well. One such artificial lift method is gas lift. In gas lift methods, a gas is injected into the wellbore downhole to lighten, or reduce the density of, the fluid column by introducing gas bubbles into the column. A lighter fluid column results in a lower bottom-hole pressure, which increases fluid production rates from the well. Gas lift is a method that is very tolerant of particulate-laden fluids and is also effective on higher gas oil ratio (GOR) wells. As such, gas lift has become a commonly utilized artificial lift method in shale oil and gas wells.

Gas lift was initially introduced in the early part of the $20^{th}$ century. With the advent of the horizontal oil shale boom in recent years, gas lift methods have enjoyed a resurgence in popularity. This is due, in part, to the ability of gas lift methods to handle solids such as frac sand, and because deviated wellbores do not impose challenges as they do with beam lift or electric submersible lift. In addition, producing bottom-hole pressures achieved with gas lift can often be below those obtained with these other forms of lift, which may be a benefit to oil and gas operators. These other forms of lift are also susceptible to problems created by gas interference. This gas interference, caused by lighter hydrocarbons vaporizing when exposed to lower pressures, only serves to increase the efficacy of gas lift.

In conventional gas lift methods, a gas lift compressor at the surface injects gas through multiple gas lift valves positioned vertically along the production tubing string. Conventional gas lift compressors typically have a discharge pressure in the range of 1,000 psig to 1,200 psig. However, there are disadvantages in conventional gas lift compressor systems. For instance, the fluid lift rates achievable by conventional gas lift compressors are typically limited, which limits the effectiveness of gas lift operations. Although conventional gas lift compressors may achieve higher lift rates than some other artificial lift methods, such as beam pumping, or the sucker-rod lift method, gas lift typically does not produce the same lift rates of other methods such as electric submersible pumps (ESPs).

To overcome limited fluid lift rates, the use of HPGL compressors has gained traction in the oil and gas industry in recent years. Typical systems include a HPGL booster compressors coupled with conventional gas lift compressors. The HPGL process is a variation on conventional gas lift methods in which no gas lift valves are required in the production tubing string. Instead, compressed gas is injected into the wellbore fluid column near the end of tubing (EOT), thereby reducing the density of the entire fluid column, which provides higher production rates as compared to conventional gas lift methods. Like conventional gas lift compressors, HPGL compressors are tolerant of particulate-laden fluids and high GORs and typically provide fluid lift rates comparable to ESPs. However, the HPGL gas lift process requires a source of compressed gas at a significantly higher pressure than the compressed gas utilized in conventional gas lift processes. HPGL gas lift compressors are typically designed to produce compressed gas at a discharge pressure of up to 4,000 psig in order to provide an adequate injection gas flow rate.

In the first half of the 20$^{th}$ century, compressor technology consisted mainly of large central compressor stations, with multiple banks of compressors. Sometimes a bank of compressors would only be designed to perform one stage of compression, with the next bank performing the next stage, and so on. Often, lean-oil "gas plants" were associated with these compressor stations. These gas plants were used to strip propane, butane, hexane, and other components known as natural gas liquids (NGL) from the gas prior to reinjection. The recovered hydrocarbons were often sold and used to generate a revenue stream. Such hydrocarbon removal also aided in the operation of gas lift distribution systems by lessening the likelihood of problems such as hydrate formation.

Compressor technology changed in the mid-20$^{th}$ century with the advent of higher horsepower engines and compressor frames having reduced footprints. The large banks of compressor buildings were replaced by smaller distributed compressor stations, with individual compressors capable of performing compression (usually three stages). The smaller distributed compressor stations are more susceptible to hydrocarbon condensation because of the lack of gas plants to remove such hydrocarbons.

Oil and gas operators typically install compressors for gas lift service at either the wellsite or at a central site to serve multiple wells. This centralized compression practice is a holdover from the 1950's, but still popular among operators who believe that centralized compression with fewer larger compressors is more cost effective than multiple smaller wellsite compressors. While it is true the larger compressors have a lower cost per unit of horsepower, the centralized compression model requires an expensive 1000 psig gas distribution system. These piping systems tend to allow the injection gas to cool to ambient earth temperature, which results in substantial hydrocarbon condensation problems since the NGL's have not been removed by a gas plant. This problem is addressed in greater detail below.

Some recent HPGL systems were deployed in horizontal unconventional wells using a booster compressor to boost pressures obtained by a conventional gas lift compressor (i.e., pressures on the order of 1000 psig) up to pressures on the order of 4000 psig as needed for HPGL. In such deployments, the high pressure booster compressor may not be needed after several months of production. This is because the required injection pressure generally declines over time to a value that may be generated without the use of the high pressure booster. However, in certain situations it may become necessary to re-introduce the high pressure booster compressor, for example, when well productivity increases substantially due to the occurrence of a "frac hit".

A frac hit is an inter-well communication event where an offset well, often termed a parent well, is affected by the pumping of a hydraulic fracturing treatment in a new well, called the child well. Gas lift, being least impacted by frac hits in comparison to beam lift or ESPs, has grown in favor partly due to this observation. However, another result of a frac hit is that the well productivity may change dramatically as a result of the frac hit. Where it may have had a very low flowing bottom hole pressure, say only 500 psig, it may change to a 2000 psig pressure with a multi-fold increase in liquid production after the frac hit than prior to the frac hit. When using HPGL, injection pressures and rates must be changed accordingly. The disclosed reconfigurable compressor may be advantageous for mitigating problems with frac hits. With the various flow options available with disclosed HPGL four stage compressors, changing injection pressure and rates is a quick and simple matter. Disclosed systems further provide the possibility of pre-loading the parent wells with high pressure gas ahead of a fracture treatment on a child well which may reduce the effects of a frac hit.

Design parameters for an HPGL system are different from those of a conventional gas sales compressor. Variables such as hydrocarbon condensation issues, and varying discharge pressure requirements must be considered. There is a long felt need for a stand-alone compressor package, specifically for HPGL applications, where the discharge pressure requirements fluctuate greatly and the feed gas is rich with heavier hydrocarbon molecules. Disclosed embodiments provide a specialized gas compressor that is designed to meet the needs of single point HPGL as well as conventional gas lift. The various parameters impacting compressor design are described below, including hydrocarbon condensation issues, compression stages required, etc.

Hydrocarbon condensation occurs when pressure and temperature are not controlled to keep compressed fluids in the vapor phase, as described in greater detail below with reference to FIG. 1. For example, a well having a rich gas having a specific gravity of 0.97 may exhibit hydrocarbon condensation leading to a 34.5% gas volume reduction. As such, for every 100 MCF discharging from the centralized compressor facility, only 65.5 MCF of vapor would come out the other end of the pipeline but would be accompanied by 21.6 barrels of liquefied petroleum components. Operators by and large ignore this problem, despite the impact to well performance and production allocation systems. Most operators are simply not aware that this problem exists. Otherwise, they would likely reconsider the decision to not to utilize wellsite compression, which has the benefit of maintaining the heat of compression all the way to the wellhead, thereby reducing or preventing hydrocarbon condensation.

When gas lift is used for an oil well application, the quantity of NGL's having high gas gravity are normally far greater than found in gas sales applications. When these NGL components go through the compression cycle, they often condense in the gas coolers (which is why they are called Natural Gas Liquids). This may cause multiple operating problems to the compression process, and may lead to additional expense, additional downtime, and environmentally un-friendly practices.

This situation is in contrast to a gas sales applications, where the gas has a much lower gas gravity, which naturally results in higher temperature increases during the compression process. Since gas being sold is normally dehydrated using a glycol dehydrator, it is important to cool the gas below 100° F. for the dehydrator to function properly. Gas sales compressors therefore have oversized gas coolers to prevent the gas from being too hot. The mindset is that it is impossible to have too much cooler capacity. This is in direct contrast to gas lift compressors which need much smaller coolers to prevent the gas from being too cold and thereby condensing the NGL components.

To address these, and other situations, according to some embodiments is described a reconfigurable multi-stage gas compressor system having a first-stage compression cylinder; a second-stage compression cylinder; and two stepped cylinders, each stepped cylinder having first and second compression cylinders. The first-stage compression cylinder may be configured to generate a first-stage compressed gas from an inlet gas, the second-stage cylinder may be configured to generate a second-stage compressed gas from the first-stage compressed gas and to feed the second-stage compressed gas to the two stepped cylinders. The two stepped cylinders may be configured to further compress the second-stage compressed gas received from the second stage compression cylinder. The gas flow paths through the stepped cylinders may be configured in a user-selectable configuration to be in series or in parallel so that the reconfigurable multi-stage gas compressor functions as one of: a three-stage compressor, as a four-stage compressor, and as a hybrid three/four stage compressor.

In some instances, the gas flow paths are configured to flow through the stepped cylinders in a series configuration, such that respective first compression cylinders of the stepped cylinders are configured to generate a third-stage compressed gas from the second-stage compressed gas; and respective second compression cylinders of the stepped cylinders are configured to generate a fourth-stage compressed gas from the third-stage compressed gas.

The fourth-stage compressed gas may be configured to exit the system through a single discharge outlet. Alternatively, the fourth-stage compressed gas is configured to exit the system through dual discharge outlets. In some cases, the fourth-stage compressed gas is configured to exit the system through a first discharge outlet, and the third-stage compressed gas is configured to exit the system through a second discharge outlet.

According to some embodiments, first, second, and third coolers are configured to respectively cool the first-stage compressed gas, the second-stage compressed gas, and a first portion of the third-stage compressed gas. In addition, first, second, and third scrubbers may be configured to process the cooled first-stage compressed gas, the cooled second-stage compressed gas, and the cooled first portion of third-stage compressed gas.

In some instances, the fourth-stage compressed gas is configured to exit the system through a first discharge outlet, the cooled first portion of third-stage compressed gas is configured to exit the system through a third discharge outlet, and a second portion of uncooled third-stage compressed gas is configured to exit the system through a second discharge outlet.

The gas flow paths may be configured to flow through the stepped cylinders in a parallel configuration, such that respective first compression cylinders of the stepped cylinders are configured to generate a first portion of third-stage compressed gas from a first portion of the second-stage compressed gas; and respective second compression cylinders of the stepped cylinders are configured to generate a second portion of third-stage compressed gas from a second portion of the second-stage compressed gas.

In some embodiments, first, second, and third coolers are configured to respectively cool the first-stage compressed gas, the second-stage compressed gas, and the first portion of the third-stage compressed gas, wherein the first portion of cooled third-stage compressed gas is configured to exit the system through a first discharge outlet, and the second portion of uncooled third-stage compressed gas is configured to exit the system through a second discharge outlet.

According to a method of operating one or more compressors described herein, a multi-stage gas compressor system comprising a first-stage compression cylinder, a second-stage compression cylinder, and two stepped cylinders, each stepped cylinder having first and second compression cylinders, the method of operating including configuring gas flow paths through the stepped cylinders in a user-configurable series or parallel configuration; generating, by the first-stage compression cylinder, a first-stage compressed gas from an inlet gas; generating, by the second-stage cylinder, a second-stage compressed gas from the first-stage compressed gas; feeding the second-stage compressed gas to the two stepped cylinders; and compressing, by the two stepped cylinders, the second-stage compressed gas received by the two stepped cylinders.

The method may further include configuring gas flow paths to flow through the stepped cylinders in a series configuration, wherein compressing, by the two stepped cylinders, the second-stage compressed gas received by the two stepped cylinders further includes generating, by respective first compression cylinders of the stepped cylinders, a third-stage compressed gas from the second-stage compressed gas; and generating, by respective second compression cylinders of the stepped cylinders, a fourth-stage compressed gas from the third-stage compressed gas.

In some cases, an operator may cause the fourth-stage compressed gas to exit the system through a single discharge outlet, or alternatively, the fourth-stage compressed gas may be configured to exit the system through dual discharge outlets.

The method may further include causing the third-stage compressed gas to exit the system through a first discharge outlet; and causing the fourth-stage gas to exit the system through a second discharge outlet.

Alternatively, an operation may include cooling the first-stage compressed gas, the second-stage compressed gas, and a first portion of the third-stage compressed gas using respective first, second, and third coolers.

In some cases, a step includes processing the cooled first-stage compressed gas, the cooled second-stage compressed gas, and the cooled first portion of the third-stage compressed gas using respective first, second, and third scrubbers.

In some examples the method includes causing the fourth-stage compressed gas to exit the system through a first discharge outlet; causing the first portion of cooled third-stage compressed gas to exit the system through a second discharge outlet; and causing a second portion of uncooled third-stage compressed gas to exit the system through a third discharge outlet.

The method may further include configuring gas flow paths to flow through the stepped cylinders in a parallel configuration; wherein compressing, by the two stepped cylinders, the second-stage compressed gas received by the two stepped cylinders further includes generating, by respective first compression cylinders of the stepped cylinders, a first portion of third-stage compressed gas from a first portion of the second-stage compressed gas; and generating, by respective second compression cylinders of the stepped cylinders, a second portion of third-stage compressed gas from a second portion of the second-stage compressed gas.

According to some embodiments, the method may further include cooling the first portion of the third-stage compressed gas; causing the cooled first portion of the third-stage compressed gas to exit the system through a first discharge outlet; and causing the uncooled second portion of third-stage compressed gas to exit the system through a second discharge outlet.

FIG. 1 shows the pressure-temperature phase diagram of natural gas relevant to the compressor technology of this disclosure, according to an embodiment. As shown, the phase diagram includes a liquid region 102, a two-phase region 104, a supercritical fluid region 106, and a vapor phase 108. Condensation of NGLs may be avoided by controlling the pressure and temperature to keep the gas in the vapor phase 108. Disclosed control methods are incorporated into new HPGL compressor of this disclosure, differentiating it from conventional gas sales/gas lift compressors. Some embodiments include cooler outlet design temperatures standardized at 150° F. minimum instead of the conventional 120° F., with the ability to have the final discharge uncooled. Such embodiments are in contrast to conventional gas compressor designs. Since temperature control equipment can fail, the compressor package may be designed to cope with hydrocarbon condensation issues. Prism style level control may be used to cope with these problems. Such control also stands in contrast to embodiments of conventional compressor designs.

Figure 2:
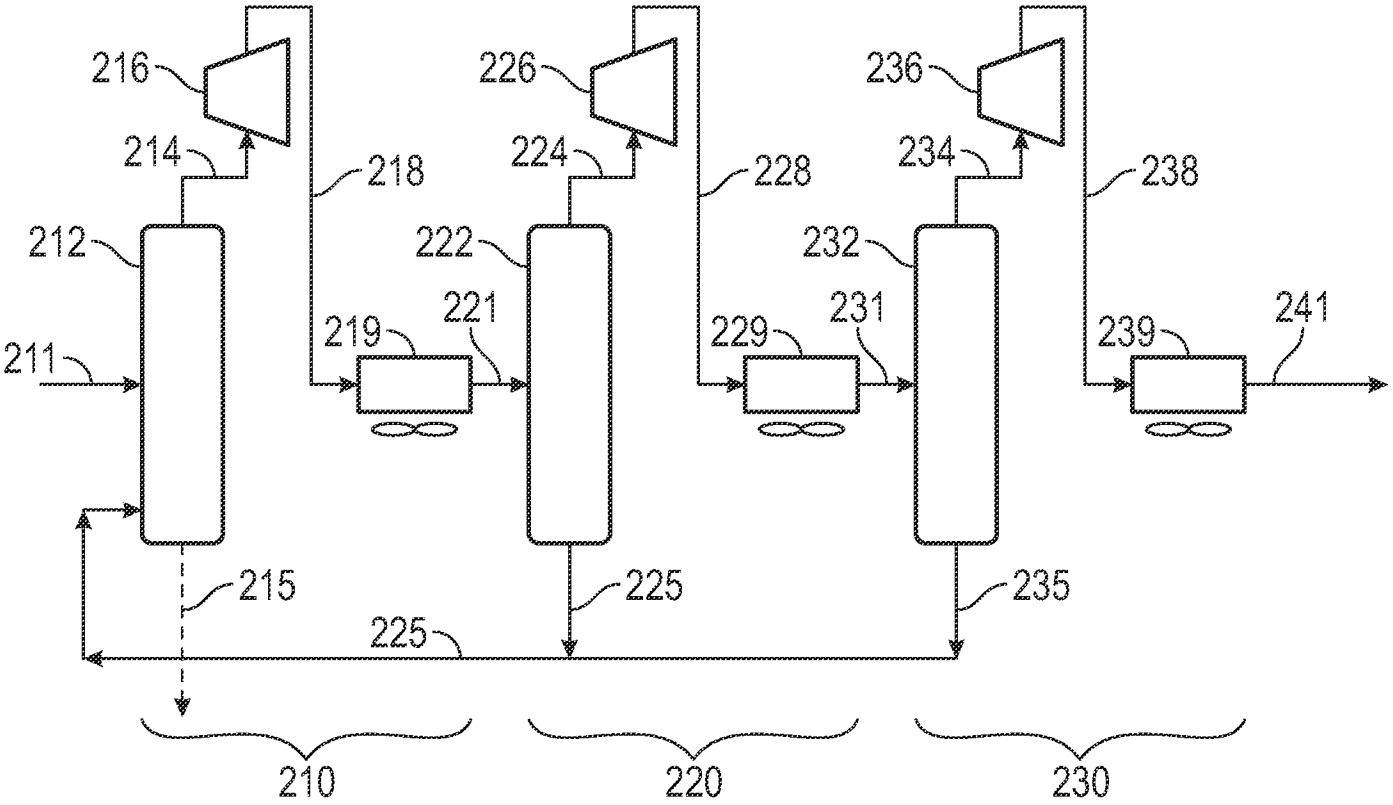
FIG. 2 illustrates a three-stage compressor cycle design, according to some embodiments.

FIG. 2 illustrates a three stage compressor cycle design, according to an embodiment. As shown in FIG. 2, there is a cooling process that occurs after each stage of compression. Such a configuration may be used in a conventional three-stage design, or as the first three compression stages in new HPGL embodiments, described below. The three stages of compression 210, 220, and 230 are described as follows.

In this example, in the first stage 210, gas enters an initial scrubber 212 through a first plumbing line 211. Liquids condensing within scrubber 212 are removed through a scrubber dump line 215. Gas leaves scrubber 212 through plumbing line 214 and enters a first stage compressor 216. Gas compressed by compressor 216 leaves through plumbing line 218 and is directed to a first cooler 219. Gas cooled by cooler 219 leaves through plumbing line 221 and enters the second scrubber 222.

In the second stage 220, liquids condensing within scrubber 222 are removed by scrubber dump line 225. Such liquids may flash vaporize upon being dumped from scrubber 222 and are therefore redirected back to first scrubber 212 as shown. Gas leaving second scrubber 222 leaves through plumbing line 224 and enters a second compressor 226. Gas compressed by compressor 226 leaves through plumbing line 228 and enters a second cooler 229. Gas cooled by cooler 229 leaves through plumbing line 231 and enters a third scrubber 232.

In the third stage 230, liquids condensing within scrubber 232 are removed by scrubber dump line 235. Such liquids may flash vaporize upon being dumped from scrubber 232 and are therefore redirected back to scrubber 212 as shown. Gas leaving scrubber 232 leaves through plumbing line 234 and enters a third compressor 236. Gas compressed by compressor 236 leaves through plumbing line 238 and enters a third cooler 239. Gas cooled by cooler 239 exits the system through plumbing line 241 and is thereby provided as third-stage compressed and cooled gas.

Figure 3:
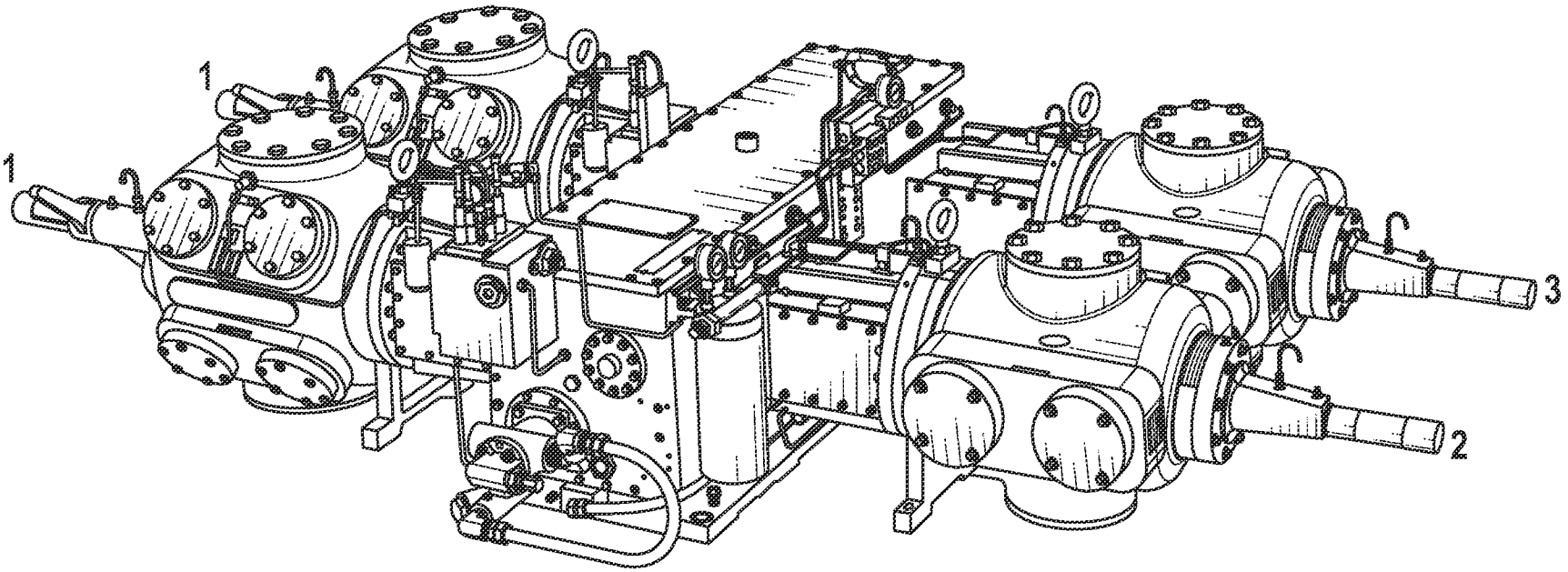
FIG. 3 illustrates a four-throw compressor that may be paired with a 350 horsepower engine, according to some embodiments.

FIG. 3 illustrates a four-throw compressor that may be paired with a 350 horsepower engine, according to an embodiment. Since most modern compressor designs are equipped with two, four, or six throws, compressor packagers must determine how to accommodate an odd number (e.g., three) of compression stages with an even number of compressor throws. The compressor of FIG. 3 may be configured to utilize the two throws on the left (each labeled "1" in FIG. 3) for the first stage. The remaining two throws (i.e., labeled "2" and "3" in FIG. 3) are used for the second and third stages respectively. Every cylinder in this example is double acting, meaning that it compresses gas when the piston rod travels in as well as when it travels out. Since horsepower is a function primarily of compression ratios and the number of molecules in the gas being compressed, and designers want to evenly distribute the amount of compression ratios per stage, the first stage cylinders consume relatively less horsepower in comparison to the second and third stages. This example demonstrates that it is possible to perform three stages of compression using a four throw machine.

Figure 4:
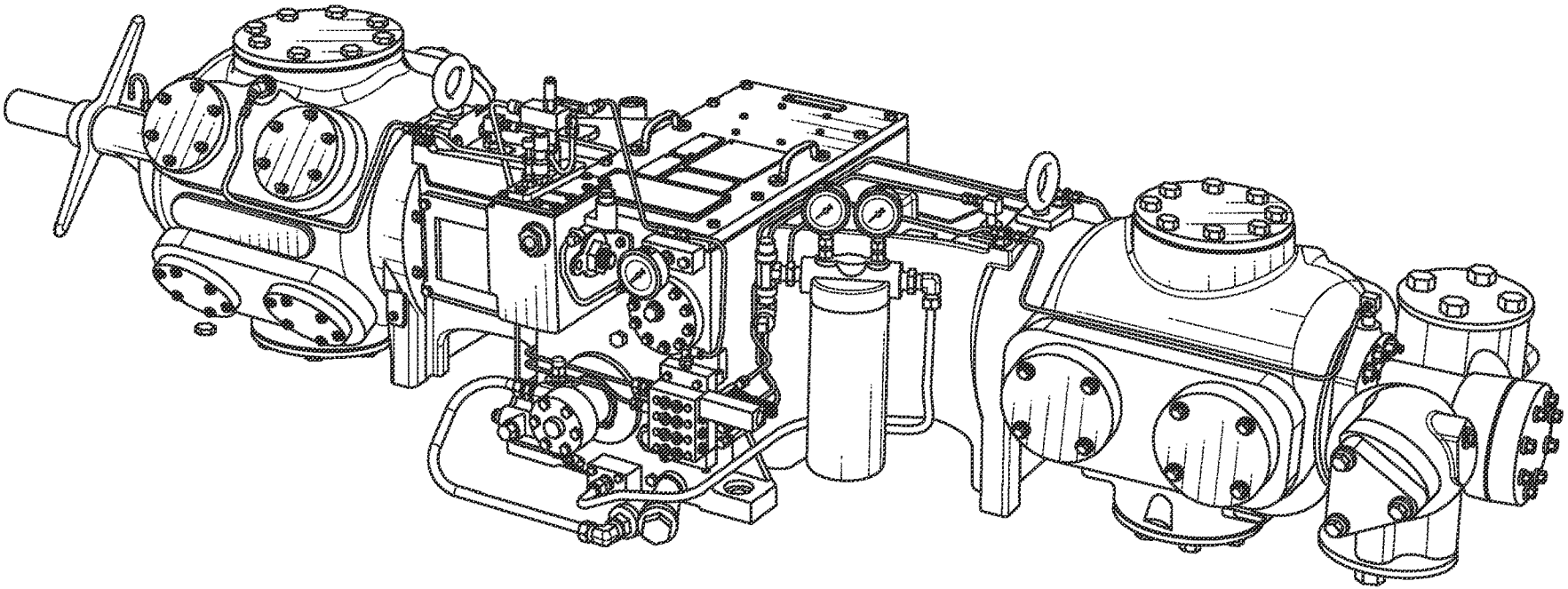
FIG. 4 illustrates a two-throw compressor that may be used for lower horsepower designs, according to some embodiments.

FIG. 4 illustrates a two-throw compressor that may be used for lower horsepower designs, according to an embodiment. In this embodiment, the throw on the right has two cylinders of different diameters sharing the same rod. These are known as tandem or stepped cylinders (e.g., see FIG. 5 and related description below). There are advantages and disadvantages to the use of stepped cylinders, but they are an important tool for the compressor packager. The point here is that a compression job requiring an odd number of compression stages may not ideally utilize a compressor frame with an even number of stages.

Figure 5:
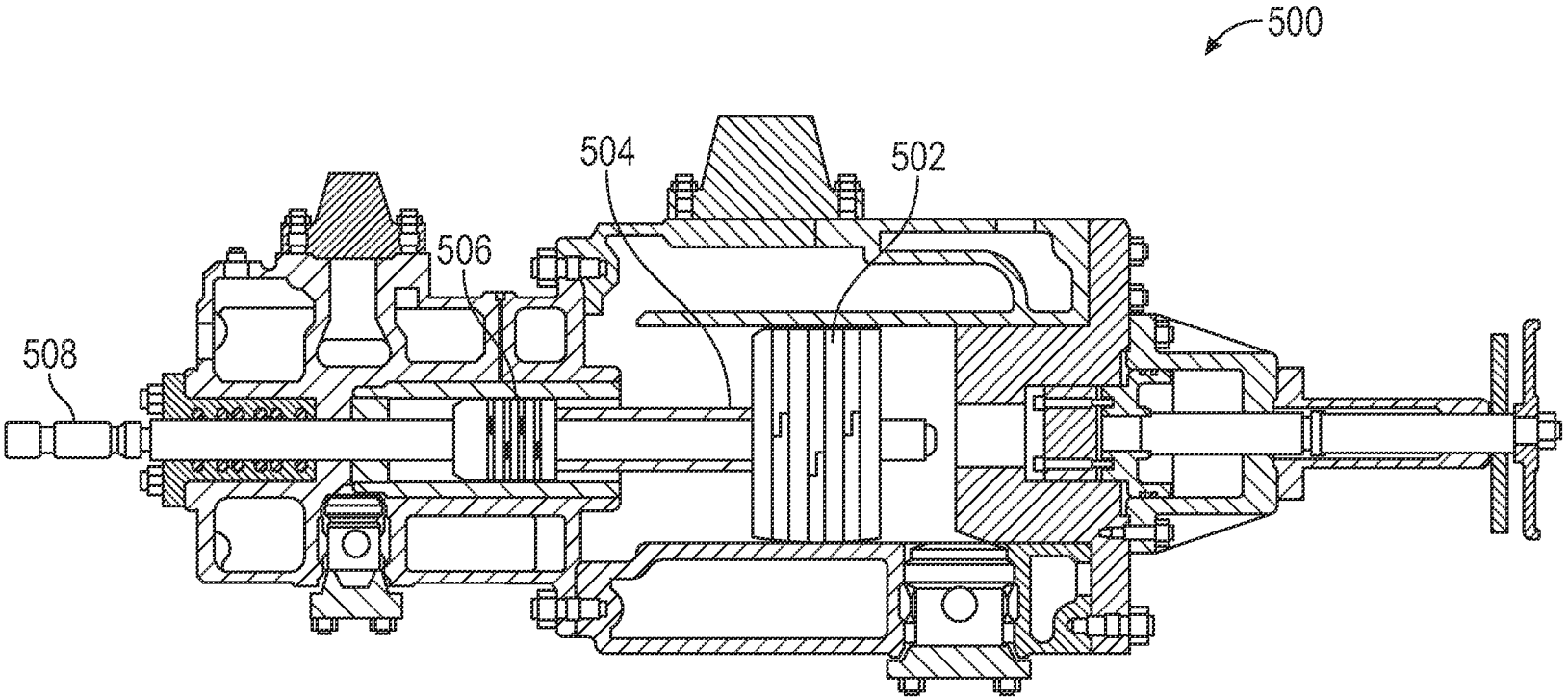
FIG. 5 illustrates a stepped cylinder having two different cylinder bores, according to some embodiments.

FIG. 5 illustrates a stepped cylinder 500 having two different cylinder bores, according to some embodiments. As shown, a stepped cylinder includes a first-stage piston 502, a spacer 504, and a second-stage piston 506. The first-stage piston 502 may have a larger diameter than the second-stage piston 506. As shown, each of the first-stage 502 and second-stage 506 pistons may be connected to a common piston rod 508 which is configured to drive both pistons at a common frequency.

Disclosed embodiments may include stepped cylinders, such as stepped cylinder 500 of FIG. 5, for single-stage or two-stage compression. Such cylinders may be used for high pressure booster compressor devices which include a reconfigurable one-stage or two-stage design. In such embodiments, once discharge pressures fall below 2700 psig, the second stage piping may be reconfigured to make the cylinders compress second stage gas in parallel with the first stage instead of being piped in series for two stage operation. Similar approaches may be used to design new HPGL devices exhibiting significant flexibility to the compressor performance, as described below with reference to FIGS. 6 to 9.

The number of compression stages needed for a HPGL compressor may be determined as follows. The design is for a single compressor that can supply 4000 psig compressed gas. Assuming an inlet suction pressure of 50 psig, or 63 psig, the total compression ratio is estimated to be 4013/63=64. Taking the cube root of this number yields 4 compression ratios per stage, which is not practical for a three-stage compressor. A four-stage compressor could do this job at 2.83 compression ratios per stage, which provides a reasonable design.

Unlike a gas sales compressor that has a fixed discharge pressure for its useable life, a gas lift compressor will see the final discharge pressure fall as the reservoir pressure depletes. A low end pressure of 500 psig is used as the minimum discharge pressure. Calculating the compression ratio in this case, yields 8 ratios, which is too few for a four stage compressor, but feasible for either a two or three stage compressor. This leads to the conclusion that a compressor could be configured as a four stage compressor initially, and then may be field changeable to a three stage configuration, as described in various disclosed embodiments below.

The horsepower requirement to compress 1 MMSCFPD from 63 psia to 4013 psia, using intercooler outlet temperatures of 150° F. was estimated to be 263 horsepower per 1 MMSCPD. Since operators performing HPGL request individual well gas lift injection rates between 1 and 3 MMSCFPD, this translates to between 263 and 789 horsepower.

Example engines for three-stage compressor embodiments include a Cummins KTA19 engine rated at 380 horsepower, and a Cummins GTA38 engine rated at 760 horsepower. Other embodiments may use any other engines as suitable to any given design. The above-cited example engines are suitable to provide the desired 1 to 3 MMSCFPD gas lift injection rates. In these example embodiments, four throw compressor frames have been utilized to perform three stage compression, using two throws for the first stage. To maintain uniformity with these three stage compressor embodiments, these same engines and frames were used to design four stage HPGL compressors. Designs using a larger Caterpillar 3512 engine rated at 1005 horsepower in combination with an Ariel JGT compressor frame have also been developed with a view toward even larger HPGL compressors that may be needed by oil and gas operators. Other engines may be used in other embodiments.

Conventional wisdom may dictate that the new HPGL compressor, described above, should have one cylinder per stage, requiring a four throw compressor. An attractive alternative, however, is to use stepped cylinders (e.g., see FIG. 5 and related description above), since high pressure cylinders often come in a stepped cylinder design. Instead of the third and fourth stages each being respectively assigned one cylinder, two stepped cylinders may be used with each stepped cylinder performing half of the third and fourth compressor throws. This means there would be two "crank end" third stage cylinders, and two "head end" fourth stage cylinders. So, half the work for the third stage may be done with each stepped cylinder, and half of the work for the fourth stage may be done by each stepped cylinder. Such complexity, however, may be offset by increased flexibility and cost savings. For example, stepped cylinders are appreciably less expensive than double acting high pressure cylinders, and there are several flow options with the stepped cylinders.

Use of stepped cylinders also has an advantage of allowing two fourth-stage discharge points for the compressor since there is a pair of stepped cylinders each generating fourth stage compressed gas. Such a system may be configured to either have a single fourth stage discharge point (e.g., see FIG. 6 and related description below) or to have dual fourth stage discharge points (e.g., see FIG. 7 and related description below). This ability to reconfigure the system compares favorably to a single discharge point for most every other gas lift compressor in existence. For example, using the Cummins GTA38 engine with a load of 700 horsepower, flow from each cylinder into two individual wells at pressures up to 4000 psig would be between 1262 to 1387 MCFPD per well at suction pressures of 50 psig and 70 psig respectively. This could be an appealing solution to oil and gas operators who face significant costs when installing automated flow control valves that function at these high pressures. Simply mechanically splitting the flow in half via the two stepped cylinders provides an easy solution. Further, if one of the wells requires an injection pressure of 2000 psig, and the other requires 3500 psig, this scenario is beneficial in that the gas is only compressed to the pressure required to enter the respective well.

This mechanical method of splitting the flow is efficient and avoids the use of automated flow valves. In contrast, in a conventional approach using automated flow control valves, one of the valves would take a pressure drop from 3500 psig down to 2000 psig. Such a practice, however, is not only wasteful but causes operational problems such as hydrate formation, due to Joule-Thomson cooling, and control valve wear.

Another option made possible by utilizing two stepped cylinders is to convert one of the stepped cylinders from four-stage to straight three-stage operation (e.g., see FIG. 8 and related description below). In this situation, one (but not both) of the fourth stage cylinders is plumbed in parallel with the two third stage cylinders. The remaining fourth stage cylinder takes a portion of the cooled third stage discharge gas and compresses it to a single well at pressures up to 4000 psig. The remaining third stage discharge gas exits the compressor through a back pressure valve that controls the third stage discharge pressure (and hence fourth stage suction pressure). For example, using the Cummins GTA38 engine at 70 psig suction pressure would supply 1500 MSCFPD at 1400 psig discharge pressure from the third stage outlet, and an additional 1495 MSCFPPD at pressures up to 4000 psig into a single well. This scenario may be valuable to an operator who in addition to a new HPGL well may also have older wells that only require 300 to 700 MCFPD each (e.g., these older wells may be HPGL wells that the operator completed in a previous year).

A further option is to convert the remaining stepped compressor to straight three stage operation (e.g., see FIG. 9 and related description below). This may be implemented once there are no longer any wells requiring HPGL. In this case, the remaining stepped cylinder may also be converted so that the fourth stage cylinder is plumbed in parallel with the other third and fourth stage cylinders, completing the conversion to three stage. Using the GTA38 engine for example, at 70 psig suction pressure the compressor would move 3509 MCFPD at pressures as high as 1750 psig, requiring 702 horsepower. At 80 psig suction with a low discharge pressure of 500 psig, the compressor would move 4250 MSCFPD, requiring 535 horsepower. With these disclosed embodiments, compressors retain respectable engine loadings and gas flow rates throughout a discharge pressure range of 500 to 4000 psig.

Figure 6:
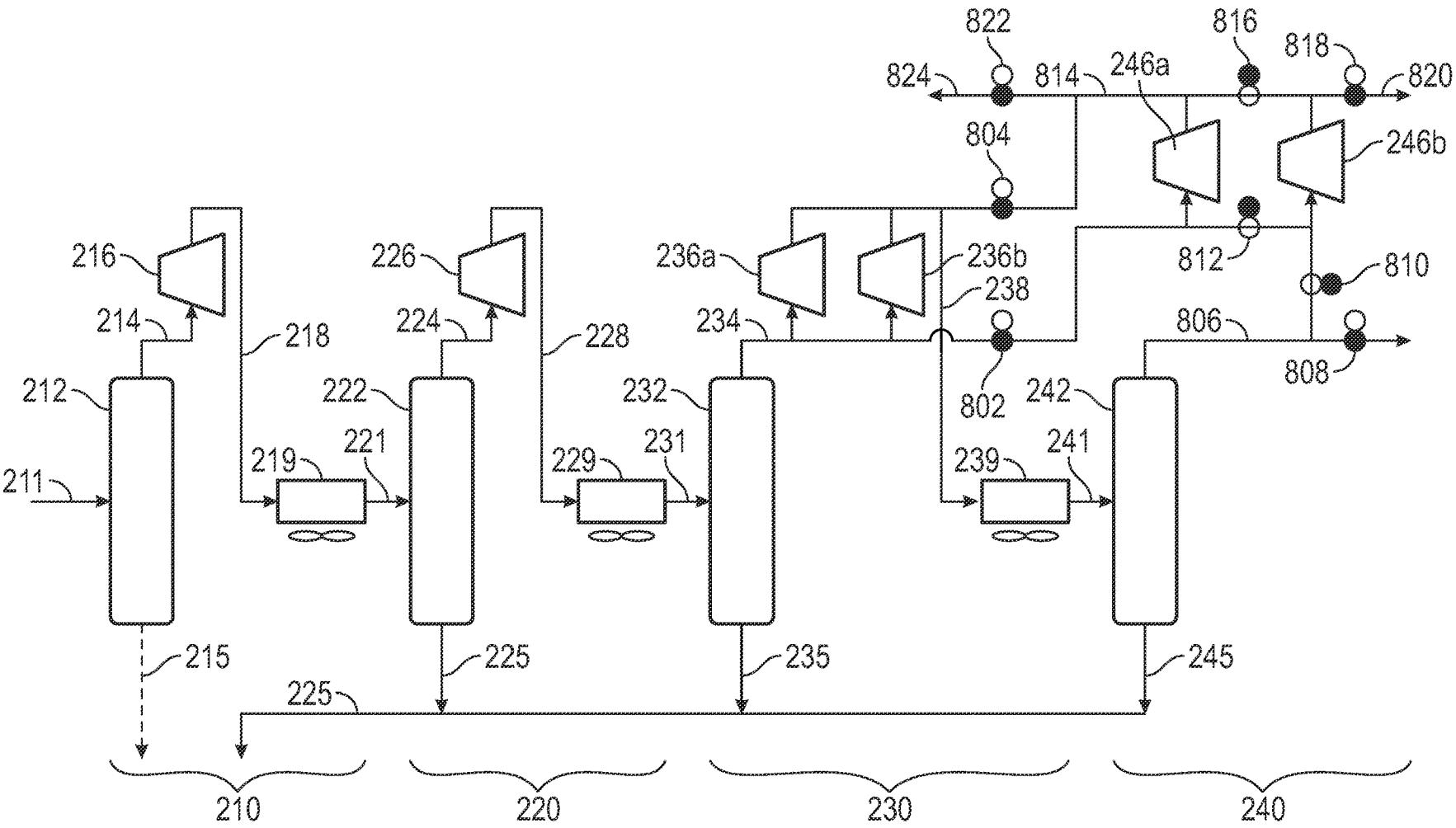
FIG. 6 illustrates a reconfigurable compressor in a first configuration having a single 4-stage discharge output, according to some embodiments.

FIG. 6 illustrates a reconfigurable compressor in a first configuration having a single 4-stage output, according to some embodiments. This example illustrates a system having four compression stages 210, 220, 230, and 240. The first two stages 210 and 220 are similar to the corresponding stages 210 and 220 of the conventional three-stage compressor described above with reference to FIG. 2. In contrast to the three-stage compressor of FIG. 2, however, the third 230 and fourth 240 stages of compression, in this example, are implemented using stepped cylinders (e.g., see FIG. 5 and related description above). As such, a first stepped cylinder may have a larger bore stage 236*a* and a smaller bore stage 246*a* (e.g., see FIG. 6). Similarly, a second stepped cylinder may have a larger bore stage 236*b* and a smaller bore stage 246*b* (e.g., see FIG. 6). Gas leaving the second scrubber 232 of second stage 220 may exit through plumbing line 234, as described above with reference to FIG. 2. From there, rather than entering a third cylinder 236, as shown in FIG. 2, gas leaving scrubber 232 may be routed to the larger bores 236*a* and 236*b* of the first and second stepped cylinders, respectively.

In this example, a closed spectacle blind 802 forces gas leaving scrubber 232 along plumbing line 234 to only flow to larger bore cylinders 236*a* and 236*b* of respective first and second stepped cylinders. A second closed spectacle blind 804 forces compressed gas leaving larger bores 236*a* and 236*b* of respective first and second stepped cylinders to travel to cooler 239 through plumbing line 238. As in the example of FIG. 2, liquid leaving scrubber 242 may leave through scrubber dump line 245.

In this example, a separate scrubber dump line 215 for the inlet separator is provided since the liquids leaving scrubber 212 normally will only minimally flash vaporize upon being dumped to an atmospheric stock tank. The remaining scrubbers 222, 232, and 242 are designed to be plumbed to a gas sales separator (not shown) just prior to being plumbed to a gas sales meter. This helps prevent a recycle situation that is common in cooler weather (i.e., NGL components repeatedly condense in the cooler, flash when dumped from the scrubber, return to the compressor via tank VRU, only to repeat this process again and again). Such a recycle processes, which is possible in a configuration such as shown in conventional three-stage configuration (e.g., see FIG. 2), increases the concentration of condensed NGL components in comparison to the lighter components.

Next, in stage 240, gas leaves scrubber 242 along plumbing line 806. A closed spectacle blind 808 on plumbing line 806 prevents third-stage compressed/cooled gas from being discharged from the system. Further, open spectacle blinds 810 and 812 allows gas leaving scrubber 242 to be directed to the smaller bores 246*a* and 246*b* of the respective first and second stepped cylinders. Fourth-stage compressed gas then flows out of the system in parallel from bores 246*a* and 246*b* through plumbing line 814 via open spectacle blinds 816 and 818. Thus, in this example, there is a single suction inlet through the first plumbing line 211 and a single 4-stage compression discharge outlet 820. In this configuration, a second closed spectacle blind 822 prevents 4-stage compression gas from exiting an alternative outlet port 824.

Figure 7:
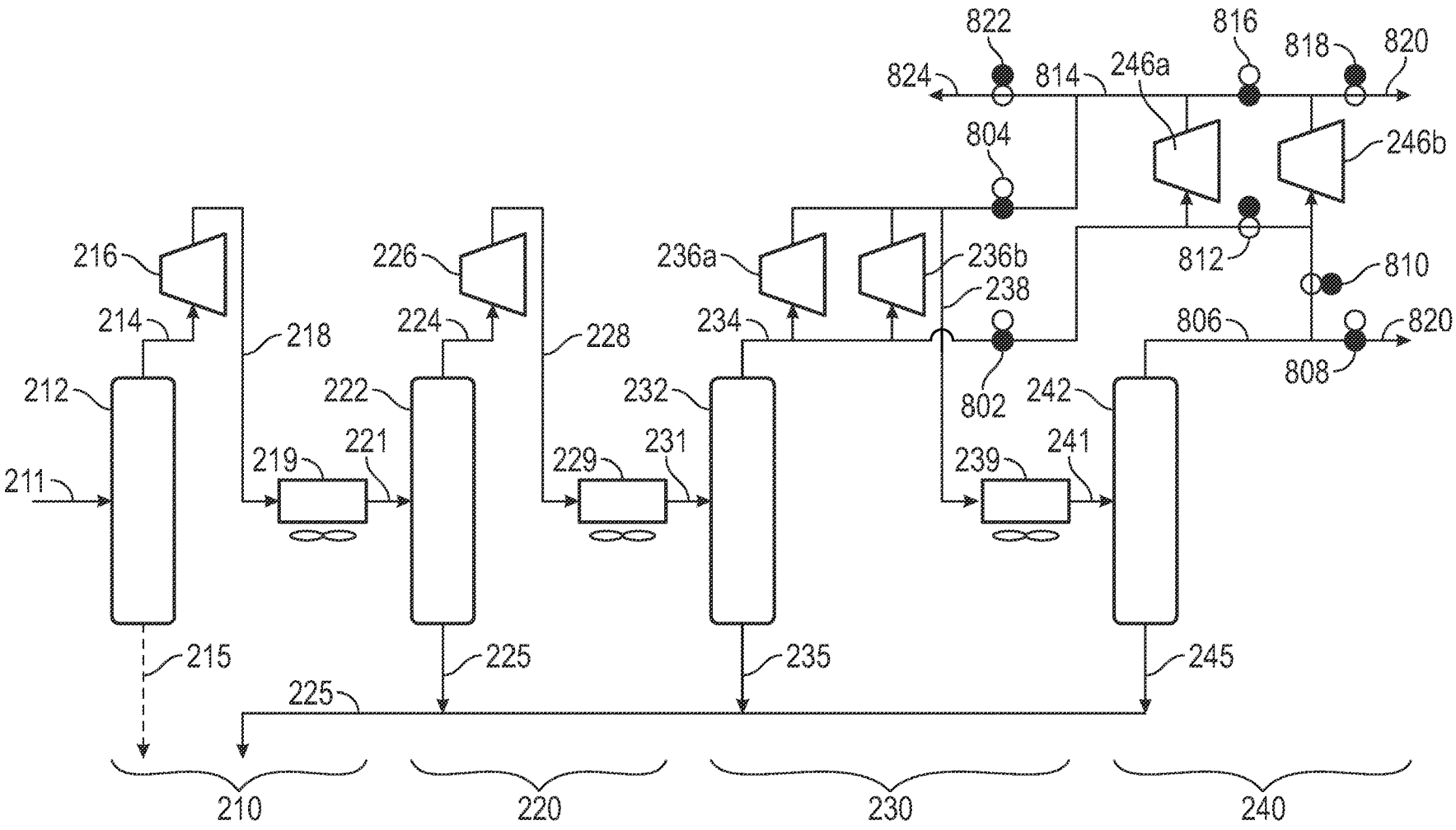
FIG. 7 illustrates a reconfigurable compressor in a second configuration having dual 4-stage discharge outputs, according to some embodiments.

FIG. 7 illustrates a reconfigurable compressor in a second configuration having dual 4-stage outputs, according to an embodiment. This configuration is the same to that of FIG. 6 with the exception that spectacle blind 822 is open in this configuration and was closed in the configuration of FIG. 6. As such, 4-stage compressed gas is allowed to flow through dual exit ports 820 and 824 with each of ports 820 and 824 delivering 50% of the compressor output.

Figure 8:
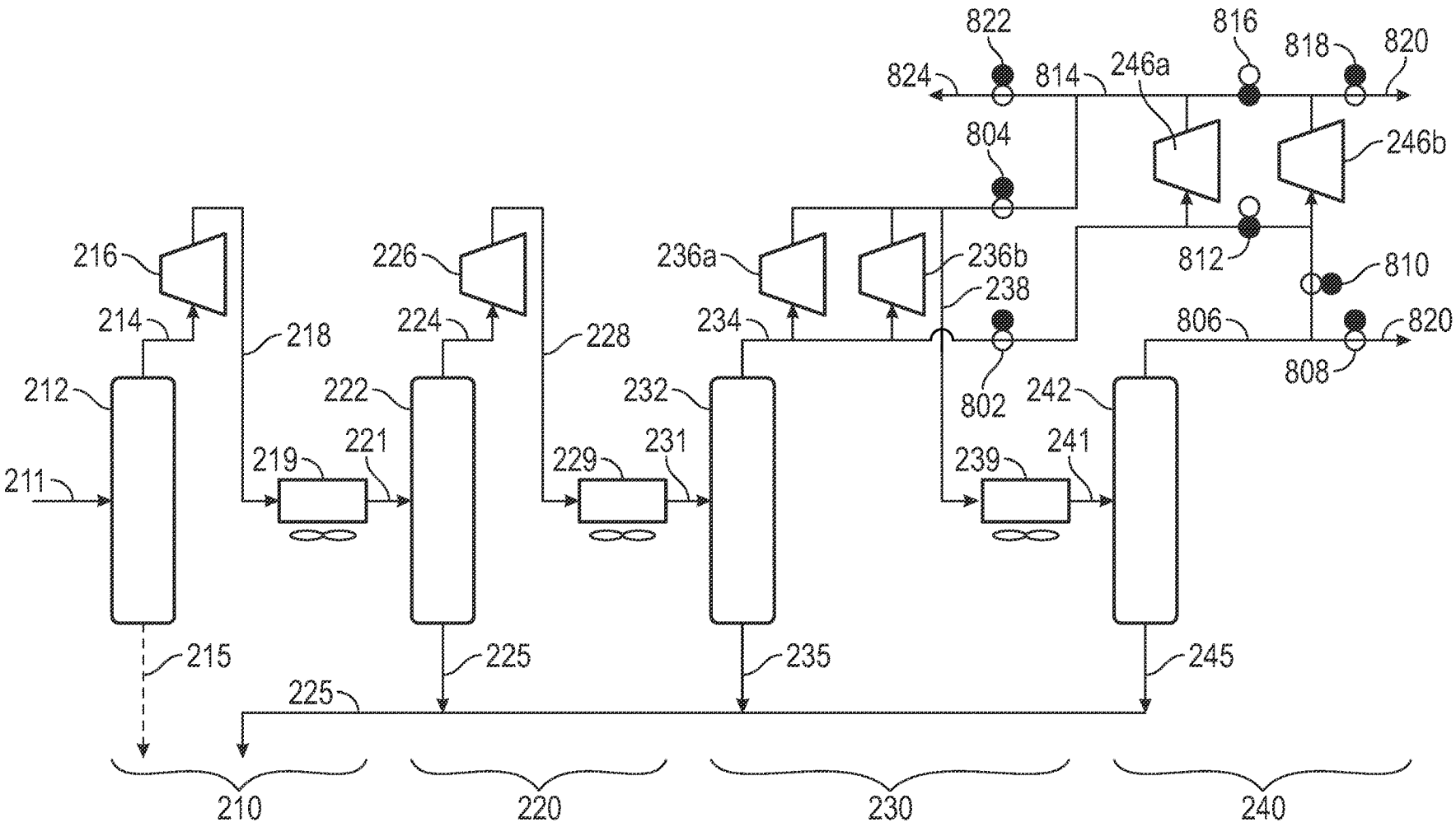
FIG. 8 illustrates a reconfigurable compressor in a third configuration having dual 3-stage discharge outputs and a single 4-stage discharge output, according to some embodiments.

FIG. 8 illustrates a reconfigurable compressor in a third configuration having dual 3-stage discharge outputs and a single 4-stage discharge output, according to an embodiment. This configuration is the same as that of FIG. 7 with the exception that spectacle blinds 802, 804, and 808 are open in this configuration. As such, 2-stage compressed gas leaving scrubber 232 flows to larger bores 236*a* and 236*b* of respective first and second stepped cylinders as before. In addition, however, since spectacle blind 802 is open and spectacle blind 812 is closed, 2-stage gas leaving scrubber 232 is also allowed to flow to smaller bore 246*a* of the first stepped cylinder. As such, larger bores 236*a* and 236*b* as well as smaller bore 246*a* each act as stage three compressors. Hot 3-stage gas therefore flows from large bores 236*a* and 236*b* through open spectacle blinds 804 and 822 and exits the system through port 824. Further, hot 3-stage gas exiting small bore 246*a* also flows through open spectacle blind 822 and flows out through port 824.

Hot 3-stage gas, exiting larger bores 236*a* and 236*b*, is also configured to flow to cooler 239 via plumbing line 238 and into scrubber 242 via plumbing line 241. From there the cooled 3-stage gas flows out of spectacle blind 808 and out through exit port 826 as cooled 3-stage gas. A portion of the cooled 3-stage gas also flows through open spectacle blind 810 and into the small bore 246*b* of the second stepped cylinder. There, the gas is compressed in a fourth stage. Lastly, because spectacle blind 816 is closed and spectacle blind 818 is open, 4-stage compressed gas flowing out of smaller bore 246*b* of second stepped cylinder flows out of the system through exit port 820. Thus, the configuration of FIG. 8 provides both hot and cooled 3-stage gas through respective ports 824 and 826 as well as 4-stage compressed gas through port 820.

Figure 9:
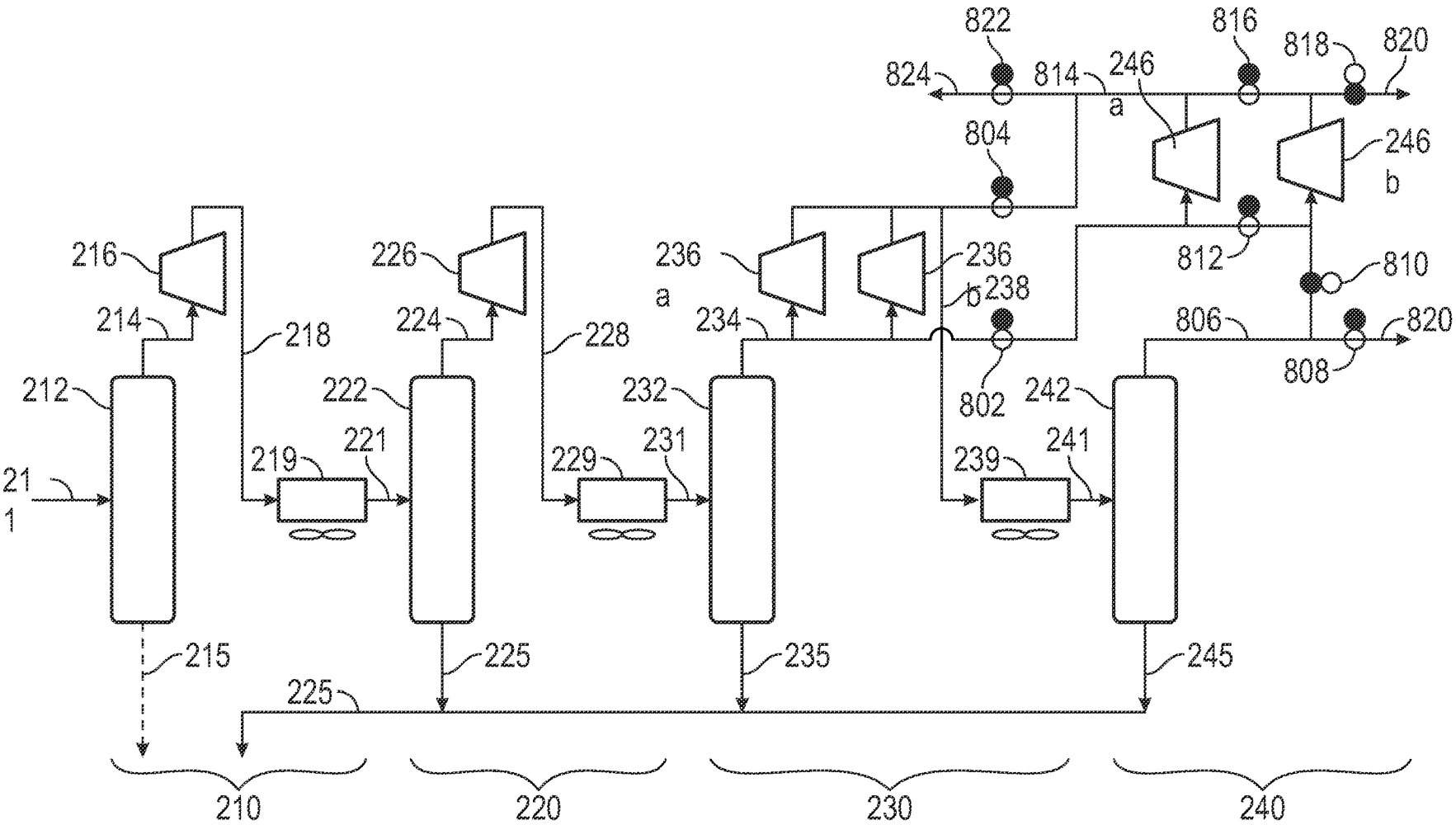
FIG. 9 illustrates a reconfigurable compressor in a fourth configuration having hot and cooled 3-stage discharge outputs, and no 4-stage discharge output, according to some embodiments.

FIG. 9 illustrates a reconfigurable compressor in a fourth configuration having hot and cooled 3-stage discharge outputs and no 4-stage discharge output, according to an embodiment. This configuration is similar to that of FIG. 8 with the exception that spectacle blinds 812 and 816 are open. As such, in a first flow path, 2-stage compressed gas leaves scrubber 232 and flows into larger bores 236*a* and 236*b* of respective first and second stepped cylinders and becomes hot 3-stage gas that flows through spectacle blind 804. In a second flow path, 2-stage gas leaves scrubber 232 and flows through open spectacle blinds 802 and 812 and into smaller bores 246*a* and 246*b* wherein it also becomes hot 3-stage gas. Hot 3-stage gas then exits smaller bores 246*a* and 246*b* and combines with hot 3-stage gas flowing from the first flow path out through spectacle blind 804. With spectacle blinds 816 and 822 open, and spectacle blind 818 closed, hot 3-stage gas from flow paths 1 and 2 combine and flow out exit port 824. In a third flow path, hot 3-stage gas flows out of larger bores 236*a* and 236*b* and into cooler 239 via plumbing line 238. From there, the cooled 3-stage gas flows into scrubber 242 via plumbing line 241, and exits scrubber long plumbing line 806. With spectacle blind 808 open and spectacle blind 810 closed, the cooled 3-stage gas flows out exit port 826. In summary, the configuration of FIG. 9 provides hot 3-stage gas through exit port 824 and cooled 3-stage compressed gas through exit port 826. There is no 4-stage compression in this configuration.

In some of the above-described embodiments, fourth stage discharges intentionally do not have a cooler, although one could be provided in some embodiments. Such a configuration has been determined to work well on the high pressure booster for its final stage. Embodiments having a third stage discharge allow configurations with both a hot 3-stage gas discharge as well as a cooled 3-stage discharge connection downstream of a scrubber (e.g., see FIGS. 8 and 9 and related description above). Although spectacle blinds are used in the above examples, the disclosure is not so limited and other types of blocking structures (e.g., locking style high temperature ball valves, with or without actuators) may be used. Configurations that include three and four stages include a backpressure valve on the outlet of stage 3 to set the suction pressure going to stage 4. Without it, high temperatures and rod loads could result.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

While embodiments of this disclosure are described with reference to various embodiments, it is noted that such embodiments are illustrative and that the scope of the disclosure is not limited to them. Those of ordinary skill in the art may recognize that many further combinations and permutations of the disclosed features are possible. As such, various modifications may be made to the disclosure without departing from the scope or spirit thereof. In addition or in the alternative, other embodiments of the disclosure may be apparent from consideration of the specification and annexed drawings, and practice of the disclosure as presented herein. The examples put forward in the specification and annexed drawings are illustrative and not restrictive. Although specific terms are employed herein, they are used in a generic and descriptive sense only and not for purposes of limitation.

The invention claimed is:

1. A reconfigurable multi-stage gas compressor system, comprising:

a first-stage compression cylinder;

a second-stage compression cylinder; and two stepped cylinders, each stepped cylinder having first and second compression cylinders, wherein the first-stage compression cylinder is configured to generate a first-stage compressed gas from an inlet gas, the second-stage cylinder is configured to generate a second-stage compressed gas from the first-stage compressed gas and to feed the second-stage compressed gas to the two stepped cylinders, wherein the two stepped cylinders are configured to further compress the second-stage compressed gas received from the second stage compression cylinder, wherein gas flow paths through the stepped cylinders are configured in a user-selectable configuration to be in series or in parallel so that the reconfigurable multi-stage gas compressor functions as one of: a three-stage compressor, as a four-stage compressor, and as a hybrid three/four stage compressor wherein in a configuration where the gas flow paths flow through the stepped cylinders in a series configuration:

respective first compression cylinders of the stepped cylinders are configured to generate a third-stage compressed gas from the second-stage compressed gas; and respective second compression cylinders of the stepped cylinders are configured to generate a fourth-stage compressed gas from the third-stage compressed gas; and first, second, and third coolers are configured to respectively cool the first-stage compressed gas, the second-stage compressed gas, and a first portion of the third-stage compressed gas; and the fourth-stage compressed gas is configured to exit the system through a first discharge outlet, the cooled first portion of third-stage compressed gas is configured to exit the system through a third discharge outlet, and a second portion of uncooled third-stage compressed gas is configured to exit the system through a second discharge outlet.

2. The compressor of claim 1, wherein the fourth-stage compressed gas is configured to exit the system through a single discharge outlet.

3. The compressor of claim 1, wherein the fourth-stage compressed gas is configured to exit the system through dual discharge outlets.

4. The compressor of claim 1, wherein the fourth-stage compressed gas is configured to exit the system through a first discharge outlet, and the third-stage compressed gas is configured to exit the system through a second discharge outlet.

5. The compressor of claim 1, further comprising:

first, second, and third scrubbers configured to process the cooled first-stage compressed gas, the cooled second-stage compressed gas, and the cooled first portion of third-stage compressed gas.

6. A reconfigurable multi-stage gas compressor system, comprising:

a first-stage compression cylinder;

a second-stage compression cylinder; and two stepped cylinders, each stepped cylinder having first and second compression cylinders, wherein the first-stage compression cylinder is configured to generate a first-stage compressed gas from an inlet gas, the second-stage cylinder is configured to generate a second-stage compressed gas from the first-stage compressed gas and to feed the second-stage compressed gas to the two stepped cylinders, wherein the two stepped cylinders are configured to further compress the second-stage compressed gas received from the second stage compression cylinder, wherein gas flow paths through the stepped cylinders are configured in a user-selectable configuration to be in series or in parallel so that the reconfigurable multi-stage gas compressor functions as one of: a three-stage compressor, as a four-stage compressor, and as a hybrid three/four stage compressor, wherein in a configuration where the gas flow paths flow through the stepped cylinders in a parallel configuration, respective first compression cylinders of the stepped cylinders are configured to generate a first portion of third-stage compressed gas from a first portion of the second-stage compressed gas;

respective second compression cylinders of the stepped cylinders are configured to generate a second portion of third-stage compressed gas from a second portion of the second-stage compressed gas; and first, second, and third coolers that are configured to respectively cool the first-stage compressed gas, the second-stage compressed gas, and the first portion of the third-stage compressed gas, wherein the first portion of cooled third-stage compressed gas is configured to exit the system through a first discharge outlet, and the second portion of uncooled third-stage compressed gas is configured to exit the system through a second discharge outlet.

* * * * *